United States Patent [19]

Bond

[11] Patent Number: 4,915,033

[45] Date of Patent: Apr. 10, 1990

[54] PARTS STACKING PALLET

[76] Inventor: Irvin D. Bond, 1027 Allen Rd., Clarkston, Mich. 48016

[21] Appl. No.: 227,099

[22] Filed: Aug. 1, 1988

[51] Int. Cl.[4] ..... B65D 19/44

[52] U.S. Cl. ..... 108/55.1; 248/346

[58] Field of Search ..... 108/55.1, 55.3, 55.5; 248/346, 558

[56] References Cited

U.S. PATENT DOCUMENTS

| | | | |
|---|---|---|---|
| 1,963,242 | 6/1934 | Nelson | 248/346 |
| 2,539,809 | 1/1951 | Buckley | 108/55.3 X |
| 2,713,471 | 7/1955 | Hirsch | 248/346 |
| 3,327,654 | 6/1967 | Duncan et al. | 108/53.1 |
| 3,877,671 | 4/1975 | Underwood et al. | 248/346 |
| 4,020,770 | 5/1977 | McLennan et al. | 248/346 X |
| 4,212,446 | 7/1980 | Domanick et al. | 248/346 X |
| 4,309,013 | 1/1982 | Howe | 108/55.1 X |
| 4,393,999 | 7/1983 | Forshee | 248/346 |

FOREIGN PATENT DOCUMENTS

| | | | |
|---|---|---|---|
| 184028 | 11/1982 | Japan | 108/55.3 |

*Primary Examiner*—Peter A. Aschenbrenner
*Attorney, Agent, or Firm*—Charles W. Chandler

[57] ABSTRACT

A pallet having a plurality of upright locating pins for guiding a stack of sheet metal stampings being individually lowered on the pallet. The lower ends of the pins are received in slots in the base in such a manner that they can be precisely located according to the sides of the stack. The pins can be located to accommodate either a small, a large or several stacks of stampings being mounted on a single pallet.

11 Claims, 3 Drawing Sheets

PARTS STACKING PALLET

BACKGROUND OF THE INVENTION

This invention is related to a pallet for precisely stacking parts, such as stampings, as they are being individually lowered on to the pallet, and more particularly to a stacking pallet having locating pins adjustable to positions precisely corresponding to the edge of the stack.

Stacking pallets are used in industrial processes for stacking identically-shaped metal stampings as they are being removed from a work station. Typically the stampings are stacked and then strapped together. The bound stack is then removed to another work station. However, such an arrangement is unsuitable in the automotive industry in which the stampings must be stacked on the pallet which is then moved with the stack to another work station.

Some industrial pallets comprise a horizontal metal base having a pattern of openings. Locating pins are mounted in an upright position on the base. The upper ends of the pins are tapered to guide the stampings onto the stack. The lower pin ends are locked in the openings in the base that are the closest to the stack sides. However, the pins cannot be precisely located so that the stampings are not precisely stacked, one on top of the other.

SUMMARY OF THE INVENTION

The broad purpose of the present invention is to provide an improved stacking pallet having upright locating pins mounted on the pallet base in precise locations accommodating the edge configuration of the stampings so that they are precisely stacked, one on top of the other.

In the preferred embodiment of the invention, a rectangular base has a series of linear slots. One end of each slot has a keyhole-shaped opening. Preferably, the slots are located in four groups, each group being located adjacent a corner of the rectangular pallet. The slots in each group are parallel to one another, and form a 90 degree angle with respect to the slots in the adjacent corners.

Each locating pin has a tubular body. A tapered cap mounted on the upper end of the body is adapted to receive a tool for rotating the cap. The cap is internally threaded to engage the upper end of an elongated insert mounted in the body. The lower end of the insert extends through the slot in the base and carries a head that is receivable through the keyhole-shaped opening.

The arrangement is such that when the insert is loose in the body, the head of the insert can be inserted through the keyhole-shaped opening, and the body precisely located adjacent the edge of a template of the stamping. When the body is in position, the cap is rotated to raise the lower head of the insert into a tight engagement with the lower surface of the base.

An alternative pin is removable by lifting it straight up from the base. This method is employed when the pin must be removed to destack the stampings.

The arrangement of slots permits the pallet to precisely stack a group of stampings having either a small diameter, a large diameter, or up to three separate stacks on the same pallet.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the views, and in which.

DESCRIPTION OF THE PREFERRED EMBODIMENT

Figure 1:
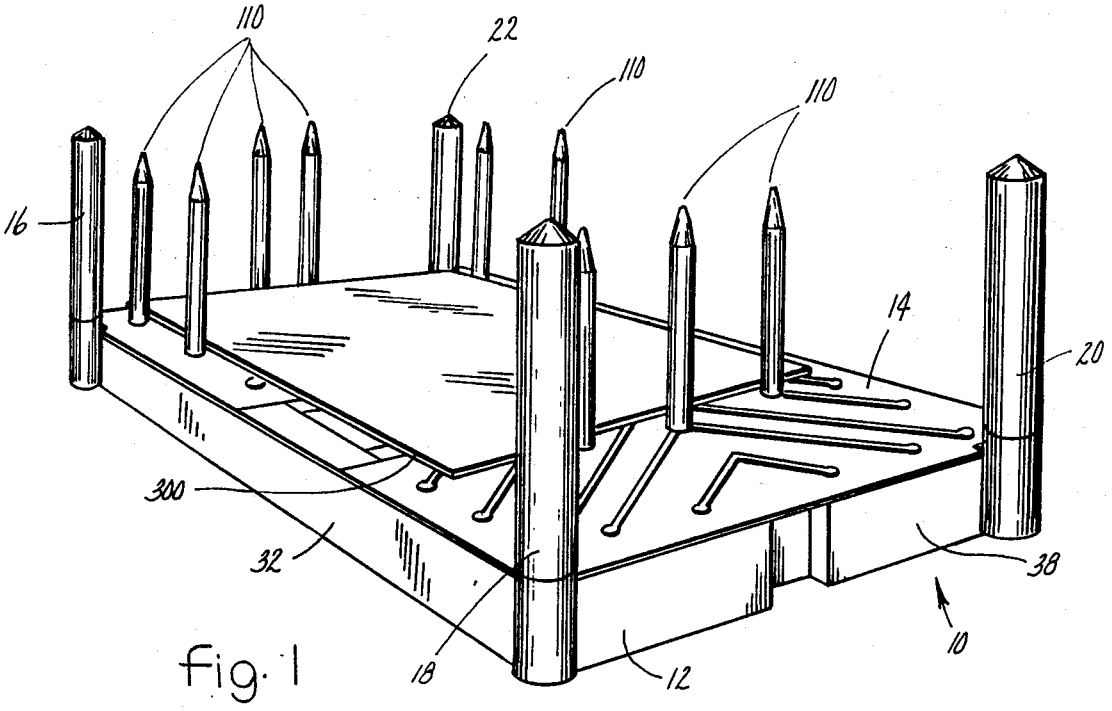
FIG. 1 is a perspective view illustrating the preferred pallet having locating pins arranged for receiving a single stack of stampings.

Referring to the drawings, a preferred stacking pallet 10 is illustrated in FIG. 1 and comprises a base 12 having a planar top 14. The base has a generally rectangular configuration and includes removable upright corner locating columns 16, 18, 20 and 22.

The locating columns are identical to one another except with respect to their location.

Figure 5:
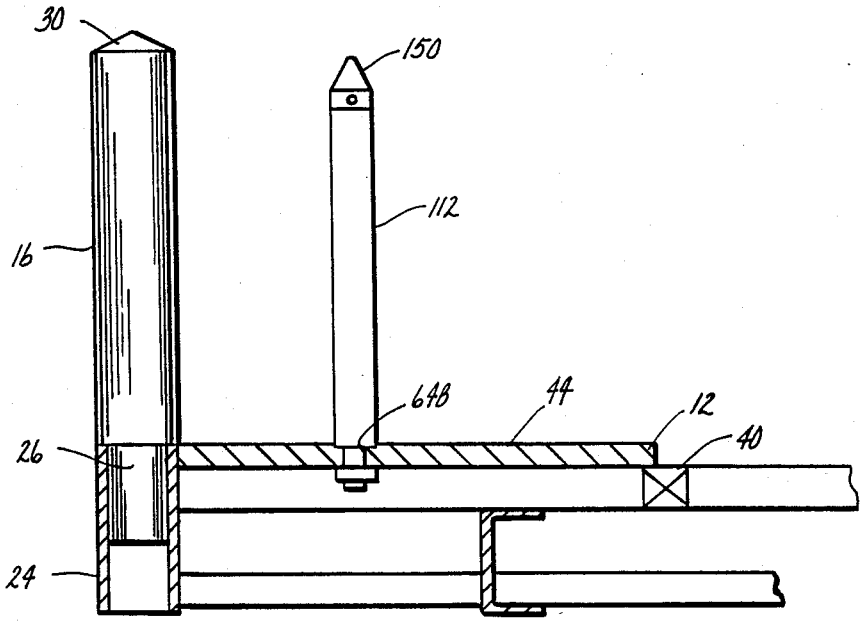
FIG. 5 is a view illustrating the manner in which a pin is mounted on the pallet base.

Referring to FIG. 5, each corner column has a tubular socket 24. Column 16, which is typical of the four columns, has a narrow, lower end 26 received in socket 24. The column is removable from an upright position. The upper end of the column has a cone-shaped tip 30. The column can be removed and a longer column mounted in position. For illustrative purposes, the column has a height of about 19 inches.

Figure 4:
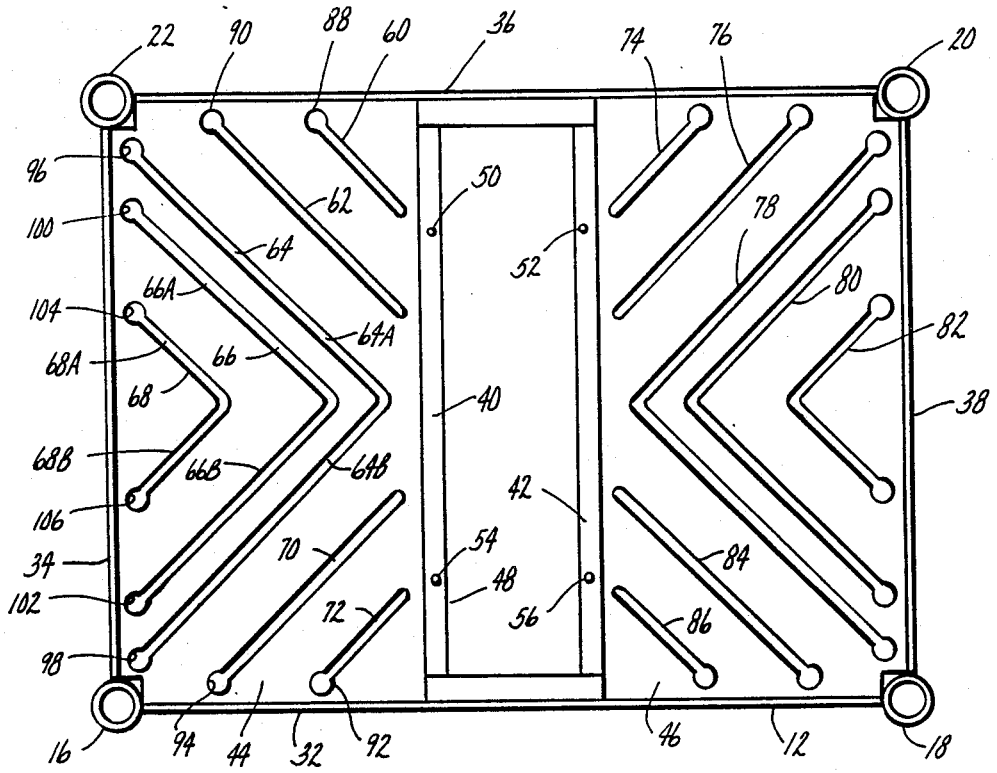
FIG. 4 is a plan view of the pallet base.

Referring to FIGS. 4 and 5, base 12 has four sidewalls 32, 34, 36 and 38. The internal structure includes a pair of parallel, spaced, centrally-located, structural members 40 and 42 that are parallel to sidewalls 34 and 38.

The base includes a pair of plates 44 and 46 mounted on structural members 40 and 42, as illustrated in FIG. 5. The two base plates are spaced to form opening 48.

Structural members 40 and 42 have locating openings 50, 52, 54 and 56 which function as master control openings for locating master templates used for setting up the locating pin locations.

Each base plate has a pattern of slots. The two plates and their slots are symmetrical to one another except for a right and left hand relationship. Base plate 44 has a pattern of slots 60, 62, 64, 66, 68, 70 and 72. Base plate 46 has a similar pattern of slots 74, 76, 78, 80, 82, 84 and 86.

Slot 60 is linear and has a keyhole-shaped opening 88 at one end. Slot 60 is parallel to but shorter than slot 62.

One end of slot 62 has a keyhole-shaped opening 90. Slots 70 and 72 are at the other end of base plate 44. Slot 72 is linear and has a keyhole-shaped opening 92. Slot 70 is disposed at right angles to slot 60, parallel to slot 72, and has a keyhole-shaped opening 94.

Slot 64 has a linear slot half 64A having one end joined to slot half 64B which is at right angles to slot half 64A. The opposite end of slot half 64A has a keyhole-shaped opening 96. The outer end of slot half 64B also has a keyhole shaped opening 98.

Slot 66 is somewhat shorter than slot 64 and is formed of two linear halves 66A and 66B having their inner ends joined to one another. Slot halves 66A and 66B are disposed at right angles, one to the other. The outer end of slot half 66A has a key-hole shaped opening 100 while the outer end of slot half 66B has key-hole shaped opening 102.

Slot 68 is shorter than slots 64 and 66 and is formed of two linear slot halves 68A and 68B which have their inner ends joined to one another, and are disposed at right angles, one to the other. The outer end of slot half 68A has keyhole-shaped opening 104 while the outer end of slot 68B has a keyhole-shaped opening 106. Slot halves 68A, 66A and 64A are all parallel to one another while slot halves 64B, 66B and 68B are also parallel, one to the other.

Openings 96, 100, 104, 106,102 and 98 are aligned along the long edge of plate 44.

The pattern of slots on base plate 46 are symmetrical to the pattern on plate 44. Slots 74 and 76 are disposed at a right angle relationship to slots 60, 62, 84 and 86; and have their longitudinal axes that is parallel to slots 70 and 72.

Figure 3:
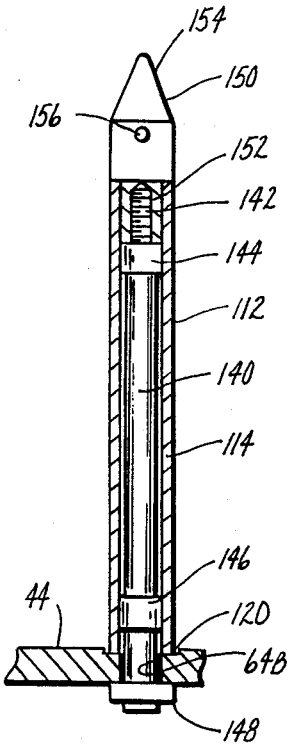
FIG. 3 is a sectional view of another preferred pin.

Referring to FIGS. 1, 3 and 5, a plurality of locating pins 110 are mounted on each base plate. A typical locating pin 112 is illustrated in FIGS. 3 and 5. Pin 112 includes an elongated tubular body 114 having a diameter greater than the width of slot 64B. The upper surface of each slot has a recessed channel 120 about $\frac{1}{8}$ inch deep for receiving the lower end of body 114.

An insert 140 is mounted in body 114. The upper end of the insert is threaded at 142. The insert has two spools 144 and 146 adjacent opposite ends of the body. The spools are vertically, slideably mounted in the body. A head 148 is mounted on the lower end of the insert, and has a diameter slightly less than that of the keyhole shaped-opening but greater than the width of the slot. Head 148 and spool 146 are adjacent the upper and lower sides of the slot, respectively. The head can be inserted through the key-hole shaped opening.

A cap 150 is mounted on the upper end of the tubular body, and has a threaded section 152 received in the body and threadably engaged with threaded end 142 of the insert. The cap has a cone-shaped tip 154, and a tool-receiving opening 156 adapted to receive a tool (not shown) for rotating the cap. The cap either lowers or raises the insert depending upon the direction of cap rotation. When the insert is being raised, lower head 148 and the lower end of the body clamp the base plate between them to lock the pin in an upright position. The other locating pins are similarly mounted on the base plate in upright positions parallel, one to the other. Each pin is mounted on the plate by loosening the lower insert head, inserting the head through a keyhole-shaped opening and then sliding the head along the slot to a position dictated by the master template. The cap is then rotated to lock the pin in position.

Figure 2A:
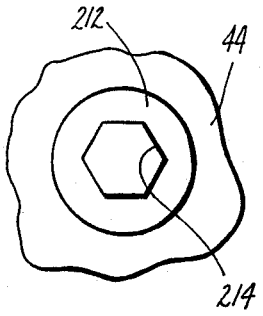
FIG. 2A is an enlarged view illustrating the hexagonal socket for receiving the pin on FIG. 2.
Figure 2:
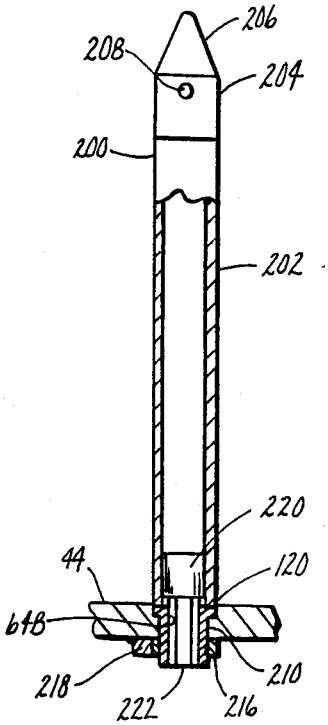
FIG. 2 is a sectional view of a preferred pin.

FIG. 2 illustrates another locking pin 200. Locking pin 200 comprises a tubular body 202. A cap 204, having a conically-shaped tip 206, is attached to the upper end of the body. Cap 204 has a tool-receiving opening 208 for receiving an elongated tool for turning the pin.

An externally threaded T-shaped socket 210 is mounted in the slot with a socket head 212 seated in the bottom of recessed channel 120. The lower threaded end of the socket extends below the lower surface of the plate. The socket has a centrally located hexagonal opening 214.

A hexagonal nut 216 is threadably mounted on the lower end of the socket for locking it in position. When this type of pin is used, an anti-rotating block 218 is attached to the lower surface of the plate adjacent the slot to engage the nut to prevent it from rotating. The socket is mounted in position by being inserted through the slot and then screwed into nut 216 to lock the socket in position.

A spool 220 is attached, as by welding, to the inside lower end of the tubular body. The spool carries a hexagonal end 222 that is slideably received in hexagonal opening 214 of the socket.

Thus it can be seen that the pin can be mounted in an upright non-rotable position by inserting lower hexagonal end 222 into hexagonal opening 214. The pin then can be removed by raising it straight up when it is to be separated from the stack of stampings.

FIG. 1 illustrates the preferred pallet with the locating pins set up to accommodate a single stack 300 of blanks.

Figure 6:
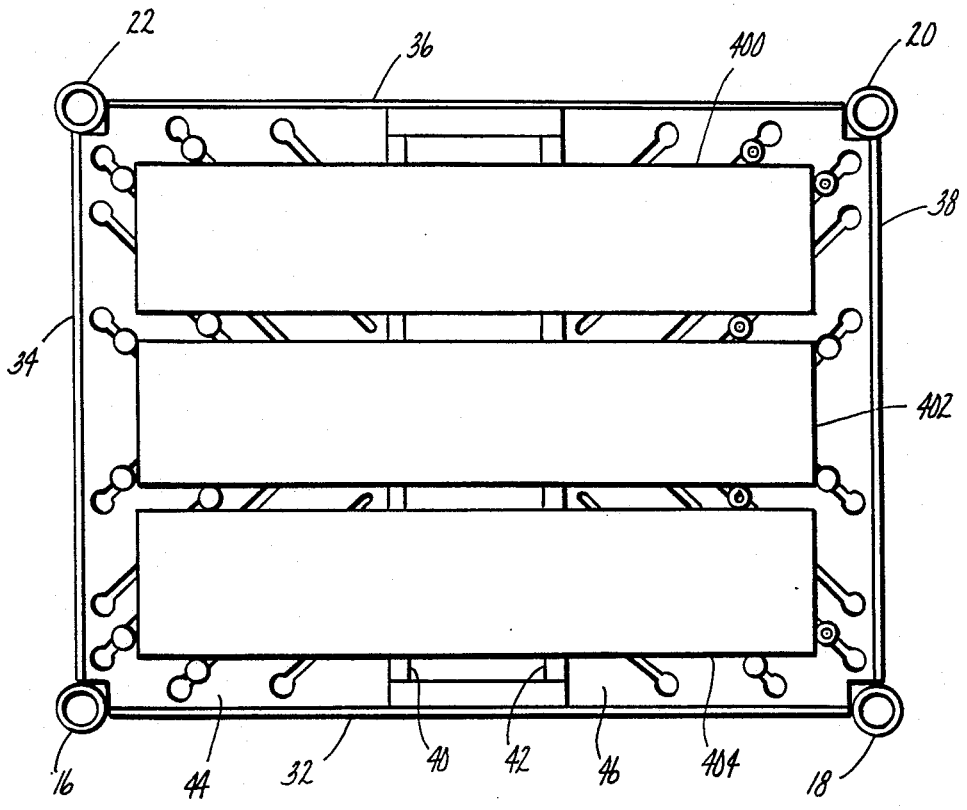
FIG. 6 is a view showing the manner in which three stacks of stampings may be mounted on a single pallet base.

Referring to FIG. 6, the stacking pallet is mounted with one or more locating pins arranged in the slots to precisely locate three stacks of blanks 400, 402, and 404.

The locating pins collectively define a guideway for receiving a stamping as it is being dropped on the pallet, and guide the stamping to a position on the stack in which its edges engage the pins. Each stamping is precisely stacked above the lower stampings with the edges of the stampings in precise alignment.

Thus it is to be understood that I have described an improved pallet having locating pins for precisely locating one or more stacks of stampings. The locating pins can be easily located, removed, installed or stored.

Having described my invention, I claim:

1. A pallet for supporting a plurality of similarly shaped parts, such as metal stampings, piled one above the other, in a stacked position, said parts each having a border with a common configuration, said pallet comprising:

a base having a planar upper supporting surface for receiving the parts in said stacked position;

the base having a plurality of slots disposed adjacent the border of the parts in said stacked position, said slots extending parallel to the plane of the supporting surface of the base;

a plurality of similarly-shaped locating pins;

each of said locating pins having a hollow body, an elongated insert received in the body, and means for connecting one end of the insert to the body;

fastener means mounted on the base for releasably connecting the other end of the insert of each locating pin to the base to support the locating pin in an upright position in an adjusted location along a corresponding one of said slots, and said locating pins being mounted on the base generally parallel to one another and being spaced around the stacked position of the parts adjacent the border thereof to prevent movement of the parts in a direction parallel to the plane of the base, whereby a part may be lowered on the base and guided to said stacked position by the locating pins.

2. A combination as defined in claim 1, including a cone-shaped cap mounted on the top of each pin.

3. A combination as defined in claim 1, in which the slot means in the base comprises a first slot, and a second slot, spaced with respect to the first slot.

4. A combination as defined in claim 1, in which the slot means comprises a first generally linear slot, and a second linear slot disposed at right angles to the first slot.

5. A combination as defined in claim 1, in which the slots include a first linear slot, and a second linear slot disposed parallel to the first linear slot.

6. A combination as defined in claim 1, in which the slots include a first linear slot having a first length, and a second linear slot spaced with respect to the first slot and having a shorter length then the first slot.

7. A combination as defined in claim 1, in which the slots include an elongated linear slot having a keyhole shaped opening at one end thereof, and each locating pin includes head means receivable through the keyhole-shaped opening at the end of the slot.

8. A pallet for supporting a plurality of similarly shaped parts, such as metal stampings, piled one above the other, in a stacked position, said parts each having a border with a common configuration, said pallet comprising:

a base having a planar upper supporting surface for receiving the parts in said stacked position;

the bore having a plurality of slots disposed adjacent the border of the parts in said stacked position, said slots extending parallel to the plane of the supporting surface of the base, and certain of said slots having a first linear slot section, and a second linear slot section disposed at right angles thereto and having one end connected to the first slot section;

a plurality of similarly-shaped locating pins;

fastener means mounted on the base for connecting the locating pins to the base in an upright position in an adjusted location along a corresponding one of said slots; and said locating pins being mounted on the base generally parallel to one another and being spaced around the stacked position of the parts adjacent the border thereof to prevent movement of the parts in a direction parallel to the plane of the base, whereby a part may be lowered on the base and guided to said stacked position by the locating pins.

9. A pallet for supporting a plurality of similarly shaped parts, such as metal stampings, piled one above the other, in a stacked position, said parts each having a border with a common configuration, said pallet comprising:

a base having a planar upper surface for supporting the parts in said stacked position;

the base having a plurality of slots disposed adjacent the border of the parts in said stacked position and extending parallel to the plane of the supporting surface of the base;

a plurality of similarly-shaped locating pins, each of said locating pins comprising an elongated tubular body having an upper end and a lower end, the lower end having a diameter greater than the width of a corresponding one of said slots, and including a locking cap movably mounted on the upper end of the tubular body, an elongated insert having an upper end threadably engaged with the locking cap, and a lower end disposed in said corresponding one of said slots, and including a fastener head mounted on the lower end of the insert having a diameter wider than the slot width such that when the locking cap is rotated, the insert is drawn upwardly to raise the fastener head to clamp the base between the tubular member and the fastener head and to support the locating pin in an upright position in an adjusted location along said corresponding one of said slots; and said locating pins being mounted on the base generally parallel to one another and being spaced around the stacked position of the parts adjacent the border thereof to prevent movement of the parts in a direction parallel to the plane of the base, whereby a part may be lowered on the base and guided to said stacked position by the locating pins.

10. A pallet for supporting a plurality of similarly shaped parts, such as metal stampings, piled one above the other, in a stacked position, said parts each having a border with a common configuration, said pallet comprising:

a base having a planar upper supporting surface for receiving the parts in said stacked position;

the base having a plurality of slots disposed adjacent the border of the parts in said stacked position and extending parallel to the plane of the supporting surface of the base;

a plurality of similarly-shaped locating pins, each of said locating pins comprising an elongated body having an upper end and a lower end, the body being mounted on the base so as to span a corresponding one of said slots, the body having a lower end, and including a socket means mounted in an adjusted position along the corresponding one of said slots, the socket means having opening means for receiving the lower end of the body such that the body is non-rotatable in the socket means in a direction about the longitudinal axis of the body, but is removable from the socket means in a direction parallel to said longitudinal axis;

fastener means mounted on the base for connecting the lower end of the elongated body to the base to support the locating pin in an upright position in said adjusted location along the corresponding one of said slots; and said locating pins being mounted on the base generally parallel to one another and being spaced around the stacked position of the parts adjacent the border thereof to prevent movement of the parts in a direction parallel to the plane of the base;

whereby a part may be lowered on the base and guided to said stacked position by the locating pins.

11. A combination as defined in claim 10, in which the lower end of the body has a hexagonal configuration, and the socket means has a hexagonal opening for receiving the lower end of the body.

* * * * *